US007803100B2

(12) United States Patent
Lu et al.

(10) Patent No.: US 7,803,100 B2
(45) Date of Patent: Sep. 28, 2010

(54) SYSTEM AND METHOD FOR MAKING A COILED STRIP OF DUNNAGE

(75) Inventors: Harry H. Lu, Mentor, OH (US); Thomas E. Manley, Mentor, OH (US); Joseph J. Harding, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 12/433,473

(22) Filed: Apr. 30, 2009

(65) Prior Publication Data

US 2009/0275457 A1 Nov. 5, 2009

Related U.S. Application Data

(63) Continuation of application No. 11/830,396, filed on Jul. 30, 2007, now abandoned, which is a continuation of application No. 10/702,225, filed on Nov. 5, 2003, now abandoned.

(60) Provisional application No. 60/423,940, filed on Nov. 5, 2002.

(51) Int. Cl.
*B31B 1/68* (2006.01)

(52) U.S. Cl. ..... 493/464; 493/407; 493/344; 493/967

(58) Field of Classification Search ..... 493/407, 493/464, 967, 351, 344
See application file for complete search history.

(56) References Cited

U.S. PATENT DOCUMENTS 3,650,877 A * 3/1972 Johnson ..... 428/222
4,237,776 A 12/1980 Ottaviano
4,444,535 A 4/1984 VanMersbergen
4,595,187 A 6/1986 Bober
4,937,131 A 6/1990 Baldacci et al.

(Continued)

FOREIGN PATENT DOCUMENTS

CA 2 141 257 7/1995

(Continued)

OTHER PUBLICATIONS

International Search Report of International Application No. PCT/US2003/035262, published on May 21, 2004 as International Publication No. WO/2004/041527.

*Primary Examiner*—Christopher Harmon
(74) *Attorney, Agent, or Firm*—Renner, Otto, Boisselle & Sklar, LLP

(57) ABSTRACT

A system, and associated components and methodology, having a dunnage supply with an outlet through which one or more crumpled strips are supplied, a positioning device that positions in juxtaposition portions of the one or more strips of dunnage, and a stapler for connecting the juxtaposed portions to hold them together. In a particular system, the system includes a converter that has a conversion assembly that converts a sheet stock material into a crumpled strip of dunnage and has an outlet through which the strip of dunnage is emitted. The system also includes a coiler that rolls the strip of dunnage into a coil, and a stapler that secures the trailing end portion of the strip of dunnage to at least the next-innermost portion of the strip in the coil by inserting a staple through the trailing end portion and the juxtaposed portion of the coiled strip.

4 Claims, 7 Drawing Sheets

U.S. PATENT DOCUMENTS

| | | | | |
|---|---|---|---|---|
| 4,968,291 | A | 11/1990 | Baldacci et al. | |
| 5,024,643 | A | 6/1991 | Kastner | |
| 5,123,889 | A | 6/1992 | Armington et al. | |
| 5,334,129 | A | 8/1994 | Haller | |
| 5,468,556 | A | 11/1995 | Fuss et al. | |
| 5,558,923 | A | 9/1996 | Vesamaa | |
| 5,617,708 | A * | 4/1997 | Weder et al. | 53/465 |
| 5,643,647 | A | 7/1997 | Wischusen, III | |
| 5,807,229 | A | 9/1998 | Febel | |
| 6,071,574 | A * | 6/2000 | Weder | 428/17 |
| 6,190,783 | B1 * | 2/2001 | Weder | 428/542.2 |
| 6,221,000 | B1 * | 4/2001 | Weder | 493/463 |
| 6,251,054 | B1 | 6/2001 | Cruz et al. | |
| 6,626,813 | B1 | 9/2003 | Ratzel et al. | |
| 6,638,584 | B1 * | 10/2003 | Weder | 428/17 |

FOREIGN PATENT DOCUMENTS

| | | |
|---|---|---|
| EP | 0 667 304 | 8/1995 |
| EP | 1 323 519 | 7/2003 |
| WO | 91/18807 | 12/1991 |
| WO | 92/09501 | 6/1992 |
| WO | 99/21702 | 5/1999 |
| WO | 01/94107 | 6/2001 |

* cited by examiner

SYSTEM AND METHOD FOR MAKING A COILED STRIP OF DUNNAGE

This is a continuation of the U.S. patent application Ser. No. 11/830,396, filed Jul. 30, 2007, now abandoned which is a continuation of U.S. patent application Ser. No. 10/702,225, filed Nov. 5, 2003, now abandoned which claims the benefit of U.S. Provisional Patent Application No. 60/423,940, filed Nov. 5, 2002, all of which are hereby incorporated herein by reference.

FIELD OF THE INVENTION

The invention herein described relates generally to a system and method for making a coiled strip of dunnage.

BACKGROUND OF THE INVENTION

In the process of shipping one or more articles, products or other objects in a container, such as boxes/cartons, from one location to another, a protective packaging material or other type of dunnage material is typically placed in the shipping container to fill any voids and/or to cushion the item during the shipping process. Converted paper dunnage material is an exemplary protective packaging material. The conversion may be accomplished by a cushioning conversion machine that typically causes inward turning of the lateral edges of sheet stock material to form a continuous strip of cushioning.

For some applications, particularly when blocking or bracing a relatively large and/or heavy item during shipping, the strip of cushioning may be "wound up" into a coil configuration to form a "coil" of cushioning product. The coil of cushioning product might then be placed in the shipping container and the large/heavy item placed thereon, and another coil of cushioning product might be placed on top of the item, if necessary or desired.

An exemplary system that includes a device, i.e., a coiler, for automatically forming a more consistent coil of cushioning product is described in International Patent Application No. PCT/US98/22726, published under Publication No. WO 99/21702, the entire disclosure of which is hereby incorporated herein by reference. As therein disclosed, a taping device can be used to secure the trailing end of the coiled strip to the coil, thus facilitating handling of the coil as it is removed from the coiler and placed in a container.

While such a taping device has provided an acceptable means of securement, further improvements in means for maintaining the strip of cushioning in a coiled configuration would be desirable.

SUMMARY OF THE INVENTION

The present invention provides a system, and associated components and methodology, for securing juxtaposed portions of one or more crumpled strips of dunnage, such as for securing the trailing end of a coiled strip of dunnage to the balance of the coil to prevent or inhibit unwinding of the coil. As also will be appreciated, features of the invention may have a wider application for securing together juxtaposed portions of dunnage to hold the same together.

More particularly, the present invention provides a dunnage-producing system having a dunnage supply having an outlet through which one or more crumpled strips are supplied, a positioning device that positions in juxtaposition portions of one or more strips of dunnage, and a stapler for connecting the juxtaposed portions to hold them together.

As used herein, a stapler is a device that inserts a staple into or forms a staple in the juxtaposed portions of dunnage to be connected. More particularly, a stapler is a device that can be inserted from one side of the juxtaposed portions to form and/or insert a staple and then withdrawn with the staple left to hold together the juxtaposed portions. Moreover, a staple is a device that has a head or insert end portion that can be inserted into at least one of the juxtaposed portions of dunnage that is configured, preferably by its own resilience, to present a dimension larger than the opening through which it was inserted, thereby inhibiting or preventing its withdrawal in the reverse direction. The staple also preferably includes a tail or retainer end portion connected by an intermediate portion to the head portion. The tail portion inhibits or prevents passage thereof through the opening or passage into the strip of dunnage through which the head portion was inserted.

The stapler can be of a type that is operable to form a staple from at least one of the juxtaposed portions and to insert the staple into another of the juxtaposed portions, thereby to mechanically lock together the juxtaposed portions. The staple can be in the form of a tab that is cut from at least one of the juxtaposed portions. Alternatively, the stapler can be of a type that is operable to insert at least one staple, such as a plastic staple, into the juxtaposed portions.

The system can include a coiler operable to roll the crumpled strip of dunnage into a coiled configuration, in which case the stapler is operable to connect a trailing end portion of the strip of dunnage to an adjacent, next-innermost portion of the strip in the coil. The positioning device can be located at the outlet of a cushioning conversion machine or converter that converts a sheet stock material into a crumpled strip of dunnage. The coiler rolls the strip of dunnage into a coil, and the stapler can secure the trailing end portion of the strip of dunnage to at least the next-innermost portion of the strip in the coil by inserting a staple through the trailing end portion and the juxtaposed portion of the coiled strip.

The present invention also provides a method of making a dunnage product that includes the steps of supplying one or more crumpled strips of dunnage, juxtaposing portions of the one or more strips, and stapling the juxtaposed portions together. An exemplary juxtaposing step includes rolling the strip of dunnage into a coiled configuration, in which case the stapling step includes stapling a trailing end of the strip to a juxtaposed next-innermost portion of the strip in the coil. An exemplary stapling step includes inserting a plastic staple having a cross-bar at one end through the strip of dunnage, a paddle at the opposite end for resisting passage through the strip of dunnage, and an elongated filament interconnecting the cross-bar and the paddle. An alternative stapling step includes cutting a tab in the strip of dunnage and pushing the tab into the strip.

The present invention also provides a dunnage product made from a sheet stock material having juxtaposed portions of one or more crumpled strips of dunnage secured together with a staple.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION OF THE INVENTION

Figure 1:
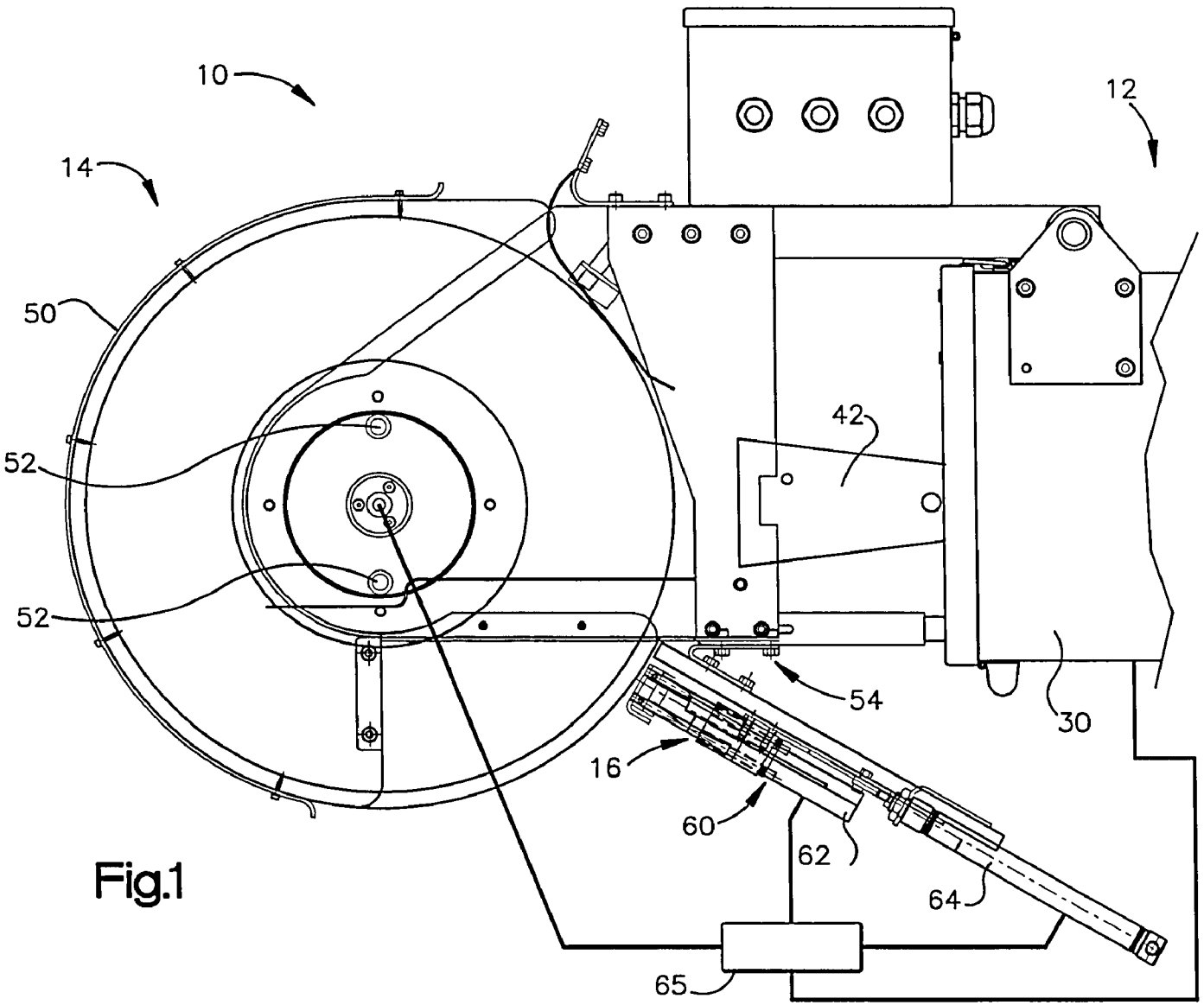
FIG. 1 is a partial elevational view of an exemplary embodiment of a system according to the present invention, including a coiler, as an exemplary positioning device, that rolls the strip of dunnage into a coil, and an exemplary stapler that connects juxtaposed portions of dunnage, e.g., the trailing end of the strip to the next innermost turn of the coil.

Referring now in detail to the drawings and initially to FIG. 1, an exemplary dunnage-producing system according to the invention is indicated generally at 10. The system includes a dunnage supply 12 that supplies a crumpled strip of dunnage, a positioning device 14 that positions in juxtaposition portions of one or more strips of dunnage, and a stapler 16 for connecting the juxtaposed portions to hold them together.

Figure 2:
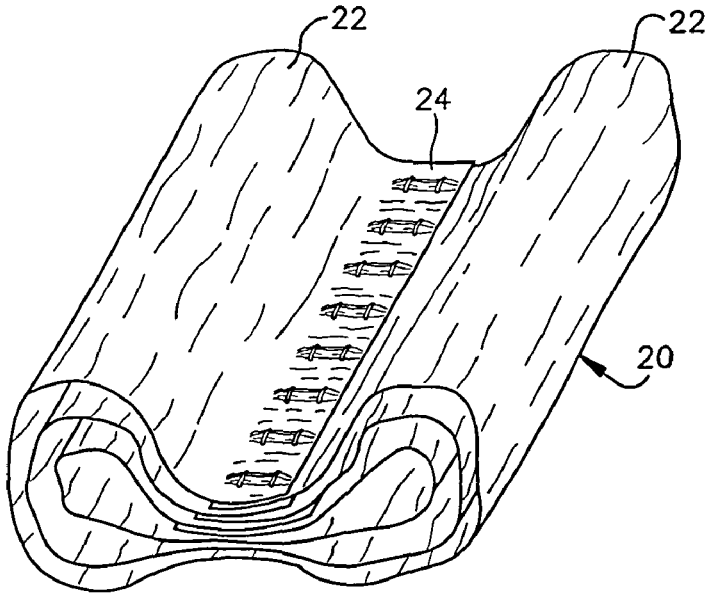
FIG. 2 is an illustration of an exemplary strip of dunnage for use with the system provided by the present invention.

An exemplary strip of dunnage provided by the dunnage supply 12 is formed of one or more plies of sheet stock material, specifically paper, and more particularly three-ply kraft paper, such as the strip of dunnage 20 shown in FIG. 2. The illustrated strip of dunnage 20 includes a pair of laterally spaced, longitudinally extending pillow portions 22 separated by a relatively narrow central band 24. Layers of stock material in the central band are connected together to maintain the shape of the strip of dunnage.

Figure 3:
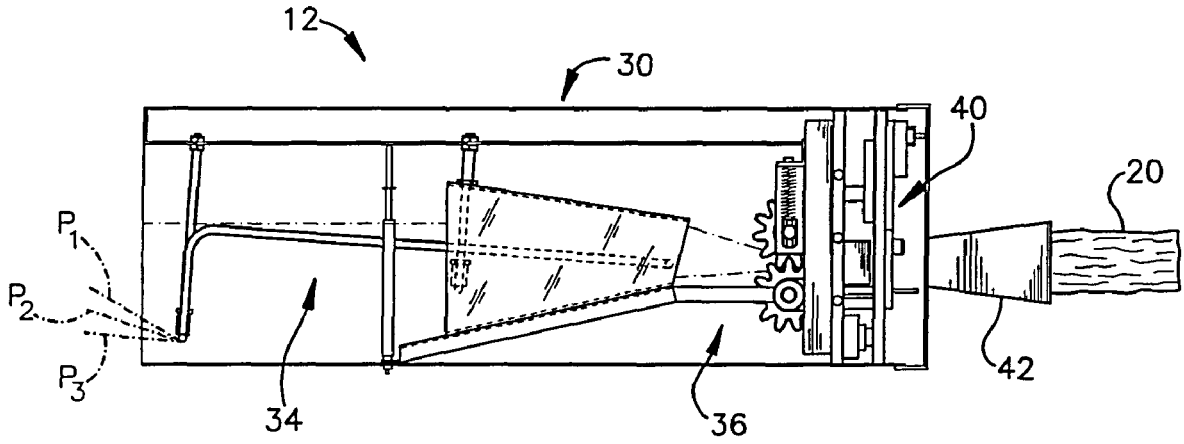
FIG. 3 is a partial cut-away elevational view of a dunnage converter for supplying a strip of dunnage.

An exemplary dunnage supply 12 includes a dunnage converter 30 (see FIG. 3) that is operable to convert one or more plies of sheet stock material (typically kraft paper) into a crumpled strip 20 of relatively less dense dunnage, such as that shown in FIG. 2. The exemplary dunnage converter 30 shown in FIG. 3 has a stock supply assembly (not shown) that supplies a multi-ply sheet stock material, such as from a roll, a conversion assembly 34 that crumples the sheet stock material and turns the lateral edges of the plies $P_1$, $P_2$, $P_3$ of sheet stock material inward, and a feeding/connecting assembly 36 that pulls the stock material through the forming assembly and connects the sheet stock material generally along the central band 24 (FIG. 2). The illustrated dunnage converter also includes a severing assembly 40 for severing the completed strip of dunnage once a desired length has been produced. The strip of dunnage 20 exits the converter through a discharge chute 42 which forms the outlet of the converter 30. Exemplary dunnage converters are shown and described in U.S. Pat. No. 5,123,889 and in published PCT Patent Application No. PCT/US01/18678 which are hereby incorporated herein by reference in their entireties. Other types of dunnage and dunnage converters can be used, including other types of paper dunnage converters, plastic air pillow converters, etc.

As shown in FIG. 1, the positioning device 14 can be a coiler 50 mounted to a downstream end of the converter 30 to receive the crumpled strip of dunnage 20 as it exits the discharge chute 42. As the strip of dunnage 20 exits the discharge chute 42, the leading end of the strip 20 passes between a pair of capture members 52 that receive the strip and then rotate as the strip continues to exit the converter 30, rolling the strip into a coil. When the strip 20 is completed, the capture members 52 continue to rotate until the trailing end of the strip is free of the discharge chute 42. An exemplary coiler is shown and described in published PCT Patent Application No. PCT/US98/22726 which also is hereby incorporated herein by reference in its entirety.

Once the coiler 50 has coiled the strip of dunnage, the stapler 16 connects the trailing end portion of the strip of dunnage to a juxtaposed portion of the next innermost turn of the coil. An exemplary stapler 16 can be an Avery Dennison™ Industrial System 1000® Bench Mount fastener attaching unit 60, available from the Avery Dennison Fastener Division in Fitchburg, Mass., U.S.A. The stapler 16 is mounted to frame member 54 by a shuttle assembly 60. The shuttle assembly 60 includes a carriage 62 driven by a pneumatic actuator 64 for advancing and retracting the stapler 16 into and out of engagement with the coiled strip of dunnage formed by the coiler 50. Appropriate sensors and controllers 65 for detecting the coiled strip, detecting engagement with the strip and operating the stapler 16 can be suitably provided. The fastener attaching unit 60 has a needle 66 for penetrating into the juxtaposed portions of the strip and for rapidly injecting a staple therein, the operation of which is explained in the following paragraphs.

Figure 8:
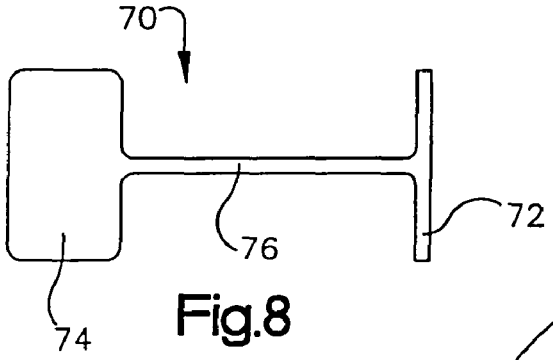
FIG. 8 is a schematic illustration of a plastic staple for use in the stapler shown in FIGS. 6 and 7.

An exemplary staple 70 inserted by the stapler 16 shown in FIG. 1 is shown in FIG. 8. The staple 70 has a flexible crossbar 72 at a head end for insertion through the strip of dunnage, a relatively inflexible paddle 74 at the opposite tail end that resists passage through the strip of dunnage, and an intermediate portion in the form of an elongated filament 76 that interconnects the crossbar 72 and the paddle 74. Such staples typically are attached by inserting the crossbar end of the staple first through the strip of dunnage. Upon insertion, the crossbar end of the staple is preferably oriented to present a dimension that is much greater than the opening through which it was inserted, thereby resisting being withdrawn through the passage in the strip of dunnage. With the crossbar end of the staple thus inserted and retained therein, the paddle end of the staple serves to keep the paddle end of the staple from being pulled into the strip. Preferably, but not necessarily, the staple 70 is inserted into a portion of the strip of dunnage that has some loft, such as the pillow portion 22 of the strip of dunnage 20 shown in FIG. 2, to facilitate the ability of the crossbar 72 to orient itself to resist pull-through in a reverse direction. The paddle end, the filament and the crossbar end are integrally formed from a plastic or a synthetic resin such as nylon or polypropylene, in a shape generally resembling a letter "H".

Figure 4:
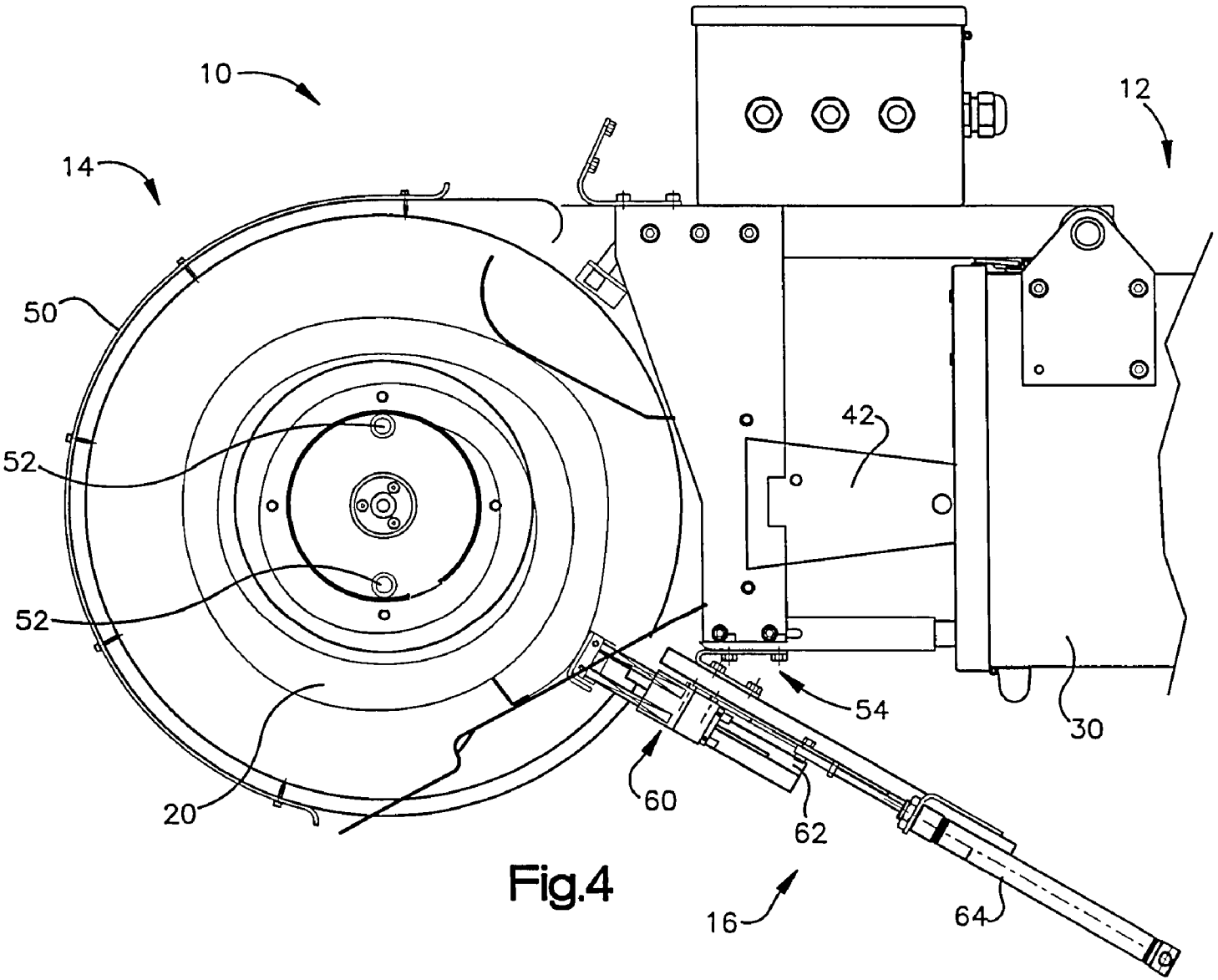
FIG. 4 is a partial elevation view of the embodiment shown in FIG. 1 with the addition of a schematic illustration of a coiled strip of dunnage.
Figure 5:
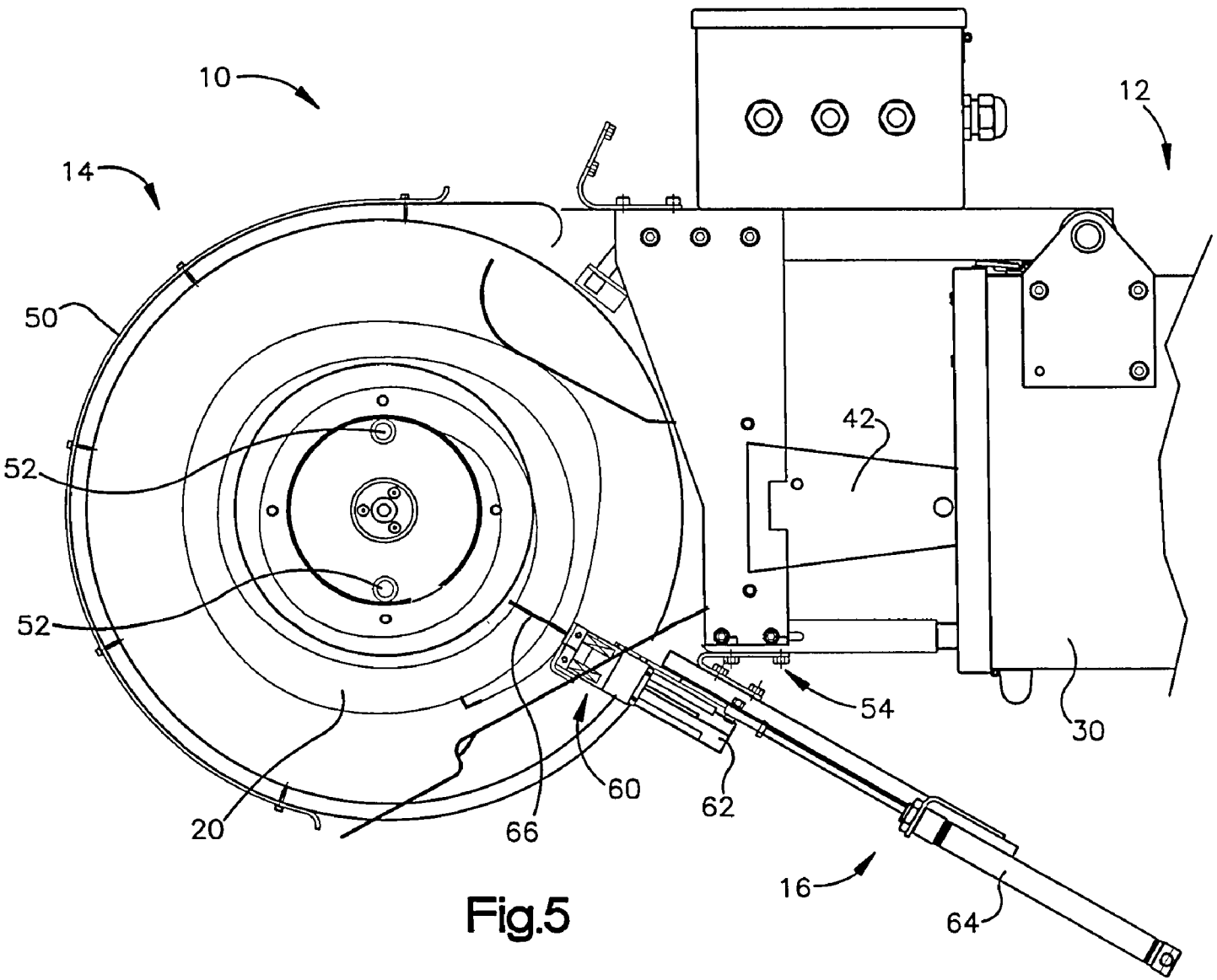
FIG. 5 is a partial elevation view of the embodiment shown in FIG. 4 with additional illustration of the operation of the stapler.
Figure 6:
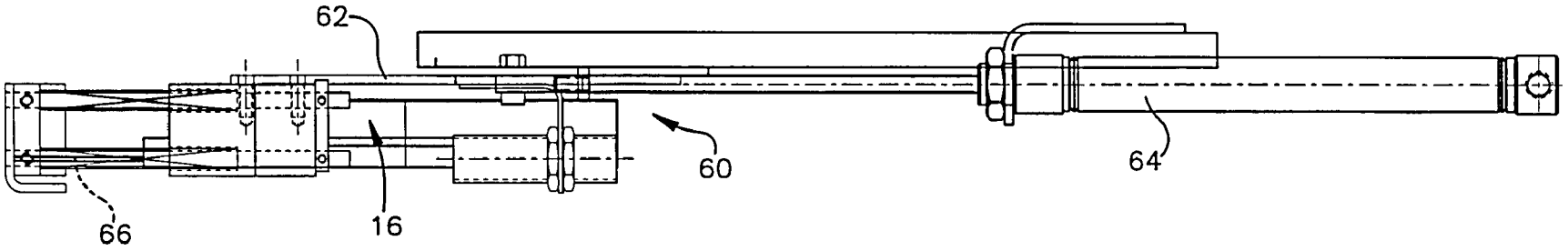
FIGS. 6 and 7 are side and top elevation views, respectively, of the exemplary stapler of FIG. 1.
Figure 7:
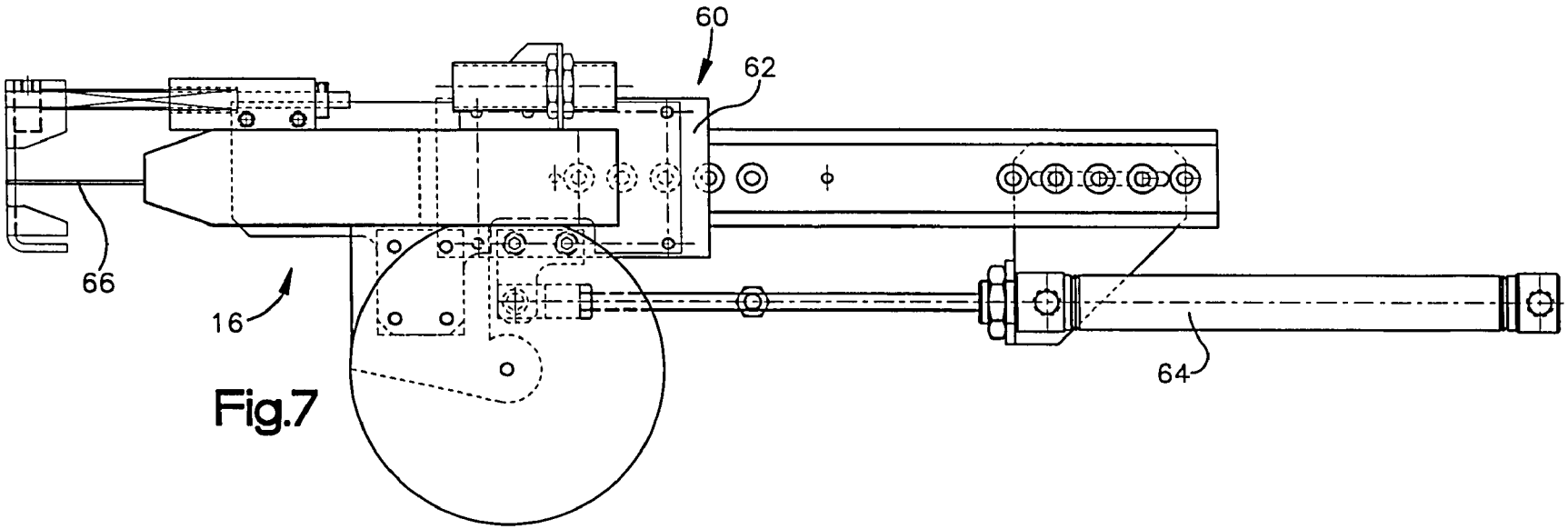

In operation, after a coil is formed in the coiler 50 shown in FIG. 4, the coiler stops and the stapler 16 is advanced toward the center of the coil, generally radially, until it engages the coiled strip of dunnage. After detecting engagement with the coil, the needle 66 is advanced to penetrate into the coil. After reaching a desired depth, the stapler 16 fires a staple through the needle 66 into the coil as shown in FIG. 5. The stapler 16 returns to a start position (FIG. 4) and the coil can be ejected from the coiler 50 without fear of the coiled strip uncoiling.

Figure 9:
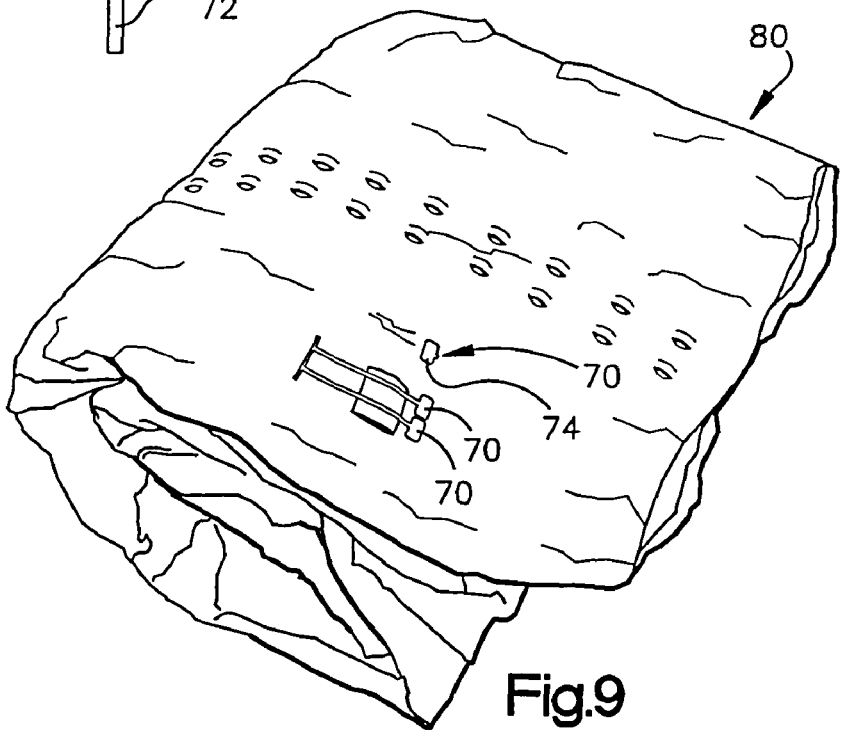
FIG. 9 is a perspective view of a coiled strip of dunnage secured by the staple shown in FIG. 8.
Figure 10:
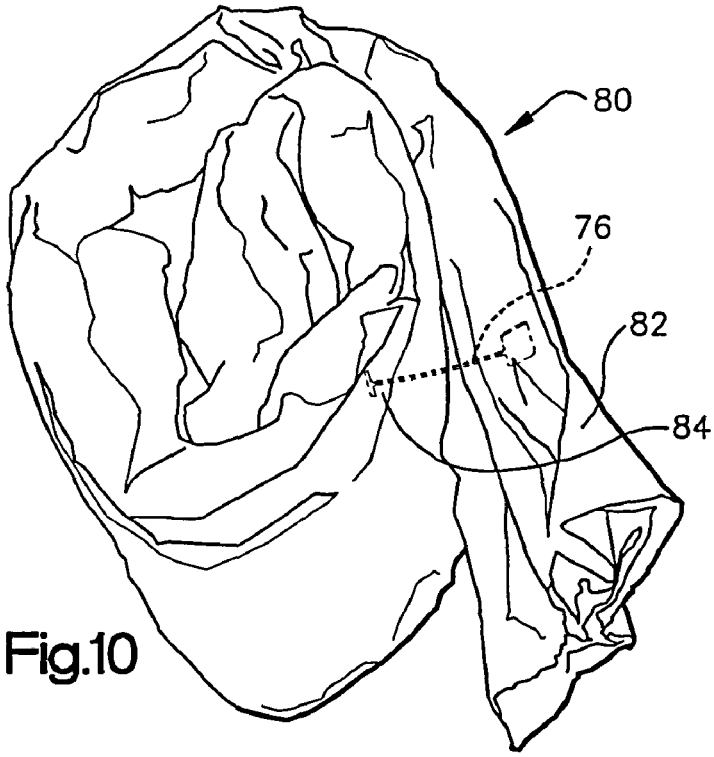
FIG. 10 is a side view of the coiled strip of FIG. 9.

An exemplary coiled dunnage product 80 provided by the present invention is shown in FIGS. 9 and 10. The dunnage product is made from a sheet stock material in the form of a strip of dunnage 20 of the type shown in FIG. 2. The strip of dunnage is rolled into a coil shape, and the outer end portion of the strip 82 is stapled to the next innermost turn of the coiled strip 84 with the type of staple 70 shown in FIG. 8. The paddle end 74 of the staple protrudes from the coiled strip in FIG. 9, and the filament 76 can be seen extending between juxtaposed portions of the strip in FIG. 10. A pair of staples 70 also are shown taped to the surface of the coiled strip for reference.

Other types of staples that can be inserted from one side to secure the juxtaposed portions of one or more strips of dunnage may be used in accordance with the present invention. Such staples may include a staple having an arrowhead tip for penetrating the juxtaposed portions that resiliently expands upon insertion to resist retraction and a wide base connected to the tip by a shaft that presents a dimension that is greater than the opening in the strip of dunnage to resist being pulled into the strip. Such a staple may also include one or more resilient barbs that further resist withdrawing the staple from the juxtaposed portions of dunnage.

Figure 11:
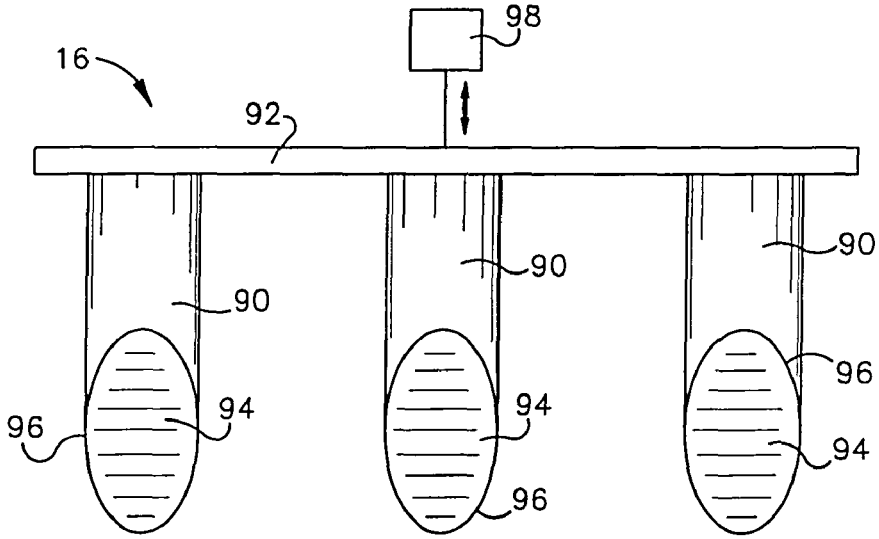
FIG. 11 is a schematic illustration of another embodiment of a stapler provided by the present invention.

Another exemplary stapler 16 is shown in FIG. 11. In this embodiment, the stapler 16 is operable to form the staple from the strip of dunnage itself. Specifically, the stapler forms a tab in the strip of dunnage and pushes the tab into the strip. The illustrated stapler 16 includes a one or more punches 90 projecting from a bar 92. The stapler typically would be positioned to array the punches across the width of the strip of dunnage. Although a variety of shapes could be used for the punches to form tabs in the strip, in the illustrated embodiment each punch is generally cylindrical, with an inclined face 94 on a distal end thereof. The peripheral edge 96 of the inclined face cuts a tab in the strip of dunnage as it is advanced therein. A control mechanism 98 of any known type may be used to controllably drive the punches into the juxtaposed portions of one or more strips of dunnage to form the tabs therein. The tab acts as a staple formed from the strip of dunnage itself.

Figure 12:
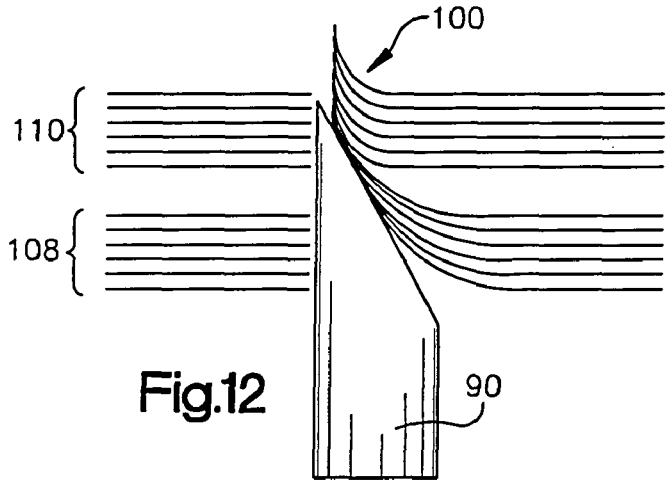
FIG. 12 is a schematic illustration of the operation of the stapler shown in FIG. 11.
Figure 13:
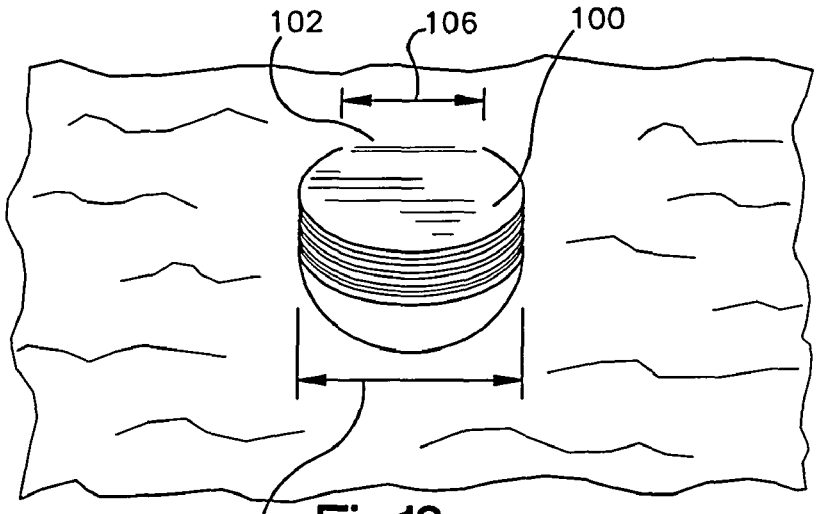
FIG. 13 is a schematic illustration of the staple formed in the strip of dunnage by the stapler of FIG. 11.

As shown in FIGS. 12 and 13, each punch 90 cuts a tab 100 generally having a C-shape with a hinge 102 at one side that connects the tab to the dunnage strip. The tab 100 has a width dimension 104 parallel to the hinge 102 that is greater than a width dimension 106 of the hinge. Thus, when the tab 100 is pushed through one or more layers of stock material, the tab 100 tends to resist being withdrawn therefrom. Consequently, when a punch cuts a tab 100 from a portion of a strip of dunnage 108 and is pushed into a corresponding opening created in a juxtaposed portion of a strip of dunnage 110, the tab holds the juxtaposed portions of stock material together.

The various operative components of the system 10 may be controlled by a logic device or controller (not shown), in a suitable manner.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of the several embodiments, such feature may be combined with one or more other features of the other embodiments as may be desired and advantageous for any given or particular application.

What is claimed is:

1. A dunnage-producing system, comprising:

a converter that is operable to convert a sheet stock material into a strip of relatively thicker and less dense dunnage having at least two layers that are fixed in an overlapping relationship, the converter having an outlet for dispensing strips of dunnage, a coiler downstream of the outlet that rolls a strip of dunnage into a coil, and a stapler downstream of the outlet and adjacent the coiler for connecting a trailing end portion of the strip of dunnage to an adjacent, next-innermost portion of the strip in the coil;

wherein the stapler is configured for injecting a plastic staple having a cross-bar at one end through the strip of dunnage, the staple having a paddle at the opposite end for resisting passage through the strip of dunnage and an elongated filament interconnecting the cross-bar and the paddle.

2. A system as set forth in claim 1, wherein the stapler is operable to insert at least one staple into the coil.

3. A system as set forth in claim 1, wherein the converter includes a conversion assembly that converts the sheet stock material into a strip of relatively thicker, narrower, and less dense dunnage.

4. A system as set forth in claim 1, wherein the coiler rolls the strip of dunnage into a coil by winding the strip about an axis that is substantially parallel to a width dimension of the strip.

* * * * *